US006032798A

United States Patent [19]

Bryant

[11] Patent Number: 6,032,798

[45] Date of Patent: Mar. 7, 2000

[54] YARN STORAGE CONTAINER

[76] Inventor: Lisa A. Bryant, 36962 Silvermine Rd., Mora, Mo. 65345

[21] Appl. No.: 09/149,347

[22] Filed: Sep. 8, 1998

[51] Int. Cl.[7] ..... B65D 85/67; B65H 49/00

[52] U.S. Cl. ..... 206/392; 206/388; 206/391; 223/107; 242/127; 242/129; 242/146

[58] Field of Search ..... 206/392, 388, 206/391, 574; 66/125 R, 132 R; 242/127, 137.1, 129, 137, 146, 160.2; 223/107

[56] References Cited

U.S. PATENT DOCUMENTS

| | | | |
|---|---|---|---|
| 1,731,347 | 10/1929 | Milosewicz | 242/137.1 |
| 2,628,042 | 2/1953 | Fitts et al. | 242/146 |
| 2,871,080 | 1/1959 | Shelly | 206/391 X |
| 3,856,140 | 12/1974 | Fitts . | |
| 4,108,397 | 8/1978 | Hanck | 292/137.1 |
| 4,154,384 | 5/1979 | Carver | 206/391 X |
| 4,319,703 | 3/1982 | Gann . | |
| 4,380,296 | 4/1983 | Murray et al. . | |
| 4,548,055 | 10/1985 | MacDonald | 206/388 X |
| 4,582,196 | 4/1986 | Hughson et al. | 206/392 X |
| 4,635,834 | 1/1987 | Lindquist | 223/107 |
| 5,150,794 | 9/1992 | Rooks . | |

FOREIGN PATENT DOCUMENTS

| | | | |
|---|---|---|---|
| 685 | 12/1862 | United Kingdom | 206/391 |

*Primary Examiner*—Bryon P. Gehman

[57] ABSTRACT

A yarn storage container 10 including a generally rectangular container member 20 divided into an upper 28 and lower 29 main compartment which are further divided by permanent 30 and removable 31 partitions into enlarged subcompartments 40 and smaller compartments 41, 42 respectively provided with spaced rows of apertures 34, 35 for dispensing strands of yarn 100 from the respective compartments 40, 41, 42.

12 Claims, 1 Drawing Sheet

YARN STORAGE CONTAINER

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of yarn holding devices in general, and in particular to a two tiered yarn storage container.

2. Description of Related Art

As can be seen by reference to the following U.S. Pat. Nos. 3,856,140; 4,319,703; 4,380,296; and 5,150,794, the prior art is replete with myriad and diverse holders for single or multiple strands of yarn.

While all of the aforementioned prior art constructions are more than adequate for the basic purpose and function for which they have been specifically designed, they are uniformly deficient with respect to their failure to provide a simple, efficient, and practical two tiered storage and dispensing container for individual skeins of yarn. The individual skeins are segregated from one another and the quantity of yarn in each compartment within the container is readily visible.

As any knitter or crocheter is all too well aware, the most difficult part of any project is the segregation of the different colored strands of yarn required to finish the project.

As a consequence of the foregoing situation, there has existed a longstanding need for a new and improved type of yarn storage container that will segregate and dispense visually monitorable quantities of yarn from a single storage container, and the provision of such a construction is a stated objective of the present invention.

BRIEF SUMMARY OF THE INVENTION

Briefly stated, the yarn storage container that forms the basis of the present invention comprises in general, a two tiered storage container unit having a novel partition arrangement and dispensing aperture array and a plurality of closure units that control access to the two tiered container unit.

As will be explained in greater detail further on in the specification, the container unit includes a generally rectangular container member divided into upper and lower main compartments wherein each of the main compartments are further provided with a first plurality of permanent partitions and a second plurality of removable partitions to divide the main compartments into enlarged sub-compartments and optional pairs of smaller compartments. Each of the sub-compartments and/or pairs of smaller compartments are dimensioned to receive quantities of different colored yarns.

In addition, the container member is provided with a first row of spaced apertures aligned in one fashion with the upper compartment sub-compartments and a second row of spaced apertures aligned in another fashion with the lower compartment sub-compartments.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
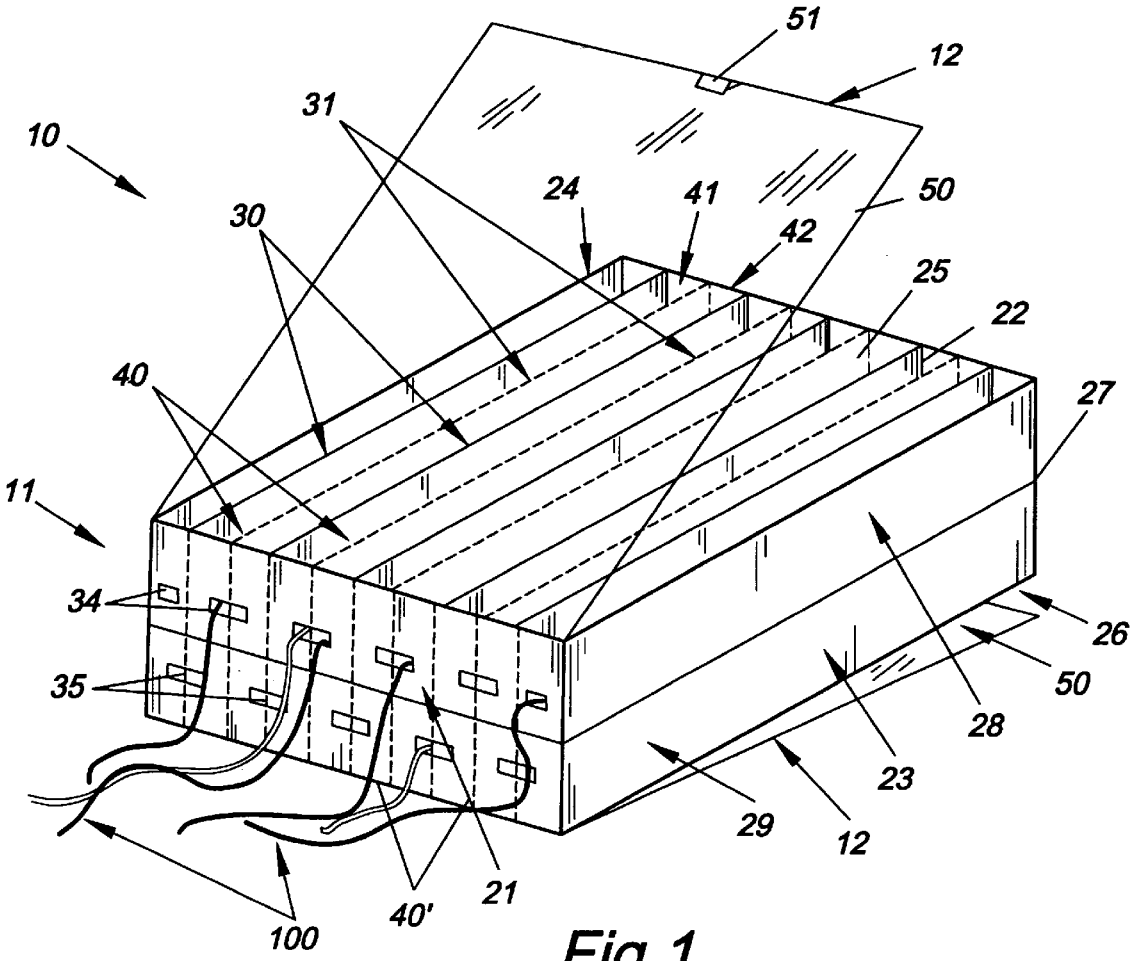
FIG. 1 is a perspective view of the yarn holding container that forms the basis of the present invention.

As can be seen by reference to the drawings, and in particularly to FIG. 1, the yarn holding container that forms the basis of the present invention is designated generally by the reference number 10. The container 10 comprises in general a two tiered container unit 11, and a plurality of closure units 12. These units will now be described in seriatim fashion.

As can be seen by reference to FIG. 1, the container unit 11 comprises a generally elongated container member 20 having a front wall 21, a rear wall 22, and opposed side walls 23, 24 which define an elongated rectangular enclosure having an open top 25 and an open bottom 26.

Furthermore, the container member 20 is provided with an elongated rectangular floor panel 27 disposed intermediate the top and the bottom of the container member 20 to divide the container member 20 into a main upper compartment 28 and a main lower compartment 29.

In addition, both the upper compartment 28 and the lower compartment 29 are provided with a plurality of permanent partitions 30 disposed at evenly spaced intervals and aligned parallel to the longitudinal axis of the container member 20 to create a plurality of enlarged storage sub-compartments 40, and a plurality of removable panels 31 whose purpose and function will be described presently.

Figure 2:
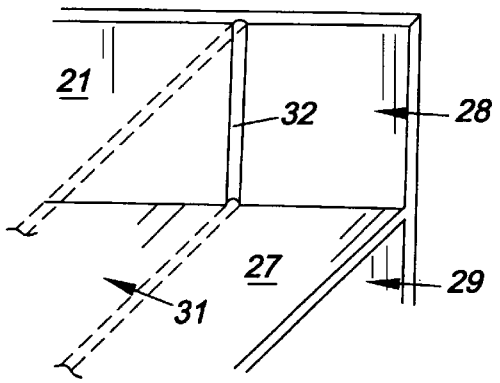
FIG. 2 is an isolated detail view of one form of operative engagement between a removable partition and a portion of the container member.
Figure 3:
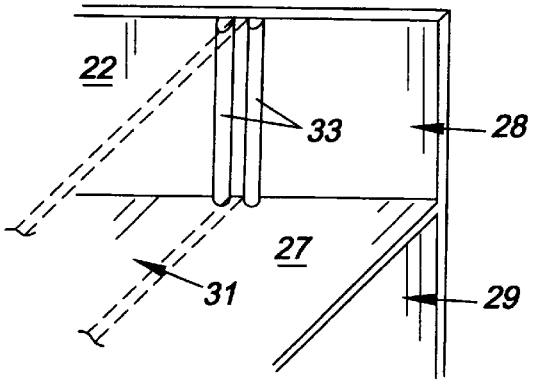
FIG. 3 is an isolated detail view of another form of operative engagement between a removable partition and a portion of the container member.

As can be seen by reference to FIGS. 2 and 3, the interior surfaces of the front 21 and rear 22 walls are provided either with slots 32 or pairs of closely spaced vertical ribs 33 which are dimensioned to slidably receive one end of the removable panels 31 in a well recognized fashion.

Returning once more to FIG. 1, it can be seen that the front wall 21 of the container member 20 is provided with an upper row 34 and a lower row 35 of spaced apertures wherein the upper row of apertures 34 are disposed intermediate the permanent partitions 30 in the upper compartment 28 and the lower row of apertures 35 are bifurcated by the permanent partitions 30 in the lower compartment 29.

As a consequence of the foregoing situation, the presence of a removable partition 31 in any one of the enlarged permanent storage sub-compartments 40 defined by the permanent partition 30 in the upper compartment 28 will divide that storage compartment 40 into two equal sized smaller sub-compartments 41, 42 which share a single aperture 34. The presence of a removable partition 31 in any one of the enlarged storage sub-compartments 40' in the lower compartment 28 will create two smaller compartments 41, 42 wherein each of the smaller compartment 41, 42 will share a portion of two different apertures 35.

By now it should be appreciated that each of the permanent upper sub-compartments 40 have a single aperture 34 whereas each of the permanent lower sub-compartments 40' share a portion of one or more of the lower row of apertures 35 wherein the presence or absence of the removably partitions 31 will increase or decrease the number of individual strands of yarn that can effectively be stored in most of the compartments 40, 40', 40, and 42.

Still referring to FIG. 1, it can be seen that the plurality of closure units 12 comprise a pair of generally rectangular lid members 50 which are hingedly connected to the top and bottom of the front wall 21 of the container member 20 wherein the free end of the lid members 50 are provided with a catch element 51 dimensioned to be releasably engaged by a latch element 48 formed on the interior of the upper and lower portions of the rear wall 22 of the container member 20.

In addition, each of the lid members 50 are fabricated from a generally transparent material so that the quantity of yarn 100 available in any given compartment 40, 41, 42 may be readily determined.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A yarn storage container comprising:

a two-tiered container unit including a generally rectangular container member having a front wall, a rear wall, two opposed side walls; wherein each of the walls has a top and a bottom, an intermediate divider panel that divides the container member into a main upper compartment and a main lower compartment wherein the upper and lower compartments are provided with a plurality of partitions which subdivide the main compartments into a plurality of enlarged sub-compartments; and, wherein the front wall of the container member is provided with a first row of spaced apertures that communicate with the enlarged sub-compartments in the upper compartment and a second row of spaced apertures that communicate with the enlarged sub-compartments in the lower compartment; wherein at least one of said apertures in each row is bisected by one of said plurality of partitions.

2. The yarn storage container as in claim 1 further comprising:

a pair of generally rectangular lid members hingedly connected respectively to the top and bottom of a selected wall of the container member.

3. The yarn storage container as in claim 2 wherein said lid members are fabricated from transparent material.

4. The yarn storage container as in claim 1 further comprising:

a pair of generally rectangular lid members hingedly connected respectively to the front wall of the container member.

5. The yarn storage container as in claim 4 wherein said lid members are fabricated from transparent material.

6. The yarn storage container as in claim 1 wherein one of said rows of spaced apertures is centrally aligned relative to the enlarged sub-compartments in a selected one of said upper and lower main compartments.

7. The yarn storage container as in claim 6 wherein said plurality of partitions comprise at least a first plurality of permanent partitions.

8. The yarn storage container as in claim 9 wherein said plurality of partitions further comprise a second plurality of removable partitions.

9. The yarn storage container as in claim 1 wherein said plurality of partitions comprise a first plurality of permanent partitions and a second plurality of removable partitions.

10. The yarn storage container as in claim 1 wherein said plurality of partitions comprise a plurality of permanent partitions.

11. The yarn storage container as in claim 1 wherein said plurality of partitions comprise a plurality of removable partitions.

12. The yarn storage container as in claim 1 wherein said plurality of partitions comprise a first plurality of permanent partitions and a second plurality of removable partitions.

* * * * *